United States Patent [19]

Peterson

[11] 4,183,721

[45] Jan. 15, 1980

[54] APPARATUS FOR AUTOMATICALLY WATER CHARGING A CENTRIFUGAL FIRE PUMP

[75] Inventor: Reuben E. Peterson, Fergus Falls, Minn.

[73] Assignee: Jenoff, Inc., Fergus Falls, Minn.

[21] Appl. No.: 869,377

[22] Filed: Jan. 13, 1978

[51] Int. Cl.[2] ..... F04D 9/04; F04B 49/04; A62C 35/16

[52] U.S. Cl. ..... 417/40; 417/199 A; 417/200; 169/13

[58] Field of Search ..... 417/199 A, 200, 40; 169/13

[56] References Cited

U.S. PATENT DOCUMENTS

| | | | |
|---|---|---|---|
| 1,995,812 | 3/1935 | Noble | 417/200 |
| 2,071,703 | 2/1937 | Nelson et al. | 417/200 |
| 2,275,500 | 3/1942 | Broadhurst | 417/200 X |
| 2,810,350 | 10/1957 | MacWilliams | 417/40 X |
| 3,050,008 | 8/1962 | Pacey et al. | 417/200 |
| 3,583,490 | 6/1971 | McFadden | 169/13 X |
| 3,941,073 | 3/1976 | Ridgeway | 417/40 X |
| 4,067,663 | 1/1978 | Brooks et al. | 417/199 A |

*Primary Examiner*—Richard E. Gluck
*Attorney, Agent, or Firm*—Zarley, McKee, Thomte, Voorhees & Sease

[57] ABSTRACT

The apparatus comprises a motor driven centrifugal pump having a suction line extending to a source of water which is located at a level below the pump. The discharge line of the pump extends to the area to be sprinkled in the event of fire. A sight glass is provided at a remote location and has a vacuum line extending from the lower portion thereof to the interior of the pump. A vacuum pump is connected to the upper portion of the sight glass for creating a vacuum within the sight glass, when actuated, so that a vacuum is created in the vacuum line extending from the sight glass to the pump so that water will be drawn from the source of water upwardly to the pump and thence to the sight glass. When a sufficient water level has been reached within the sight glass, the motor operating the centrifugal pump is energized so that water will be discharged onto the area experiencing the fire. The vacuum pump is controlled by means of an alarm system located in the area to be protected.

2 Claims, 8 Drawing Figures

APPARATUS FOR AUTOMATICALLY WATER CHARGING A CENTRIFUGAL FIRE PUMP

BACKGROUND OF THE INVENTION

In rural areas, the fire fighting equipment is sometimes less than desirable. It has therefore become necessary for companies owning grain elevators or the like to establish their own fire fighting equipment. Frequently, centrifugal or turbine fire pumps are provided on site to pump water from an underground water supply onto the area experiencing the fire. The use of centrifugal pumps does create several problems since centrifugal pumps do not have the ability to establish a wet suction from the stored water supply when the storage tank is below pump level. Since the pump must have a solid charge of water before it is operated, some means of establishing a dependable prime must be provided since it is destructive to high-speed turbines to even operate only a few revolutions without water. If the water supply was located above the pump, water would be continually supplied to the pump but most locations do not have sufficient grade to position the large water storage tank above the pump. Additionally, the continual presence of water within the pump is quite harmful to the pump since many rural areas have extremely corrosive water supplies.

Several current methods of priming centrifugal pumps are presently being employed. Among the most common methods are: (1) positive head or flooded suction; (2) priming from draft; (3) hand operated vacuum pump ejector priming; (4) electric pump priming; and (5) retention of water at pump level by a foot valve. None of the above methods function without the aid of manual operation and someone must be on the site when the fire pump is operated.

Therefore, it is a principal object of the invention to provide an automatic means for positively charging a centrifugal water pump wherein the water supply is located below the pump.

A still further object of the invention is to provide an apparatus for positively charging a centrifugal pump which allows the pump to be operated only when the pump has sufficient water therein so as to prevent damage thereto.

A still further object of the invention is to provide an automatic vacuum and water charge system for a positive water pump prime prior to the water pump being actuated.

A still further object of the invention is to provide an apparatus for positively charging a centrifugal fire pump including means for deactivating the fire pump if the prime is lost.

A still further object of the invention is to provide an automatic fire protection system which is ideally suited for rural areas.

These and other objects will be apparent to those skilled in the art.

DESCRIPTION OF THE PREFERRED EMBODIMENT

Figure 1:
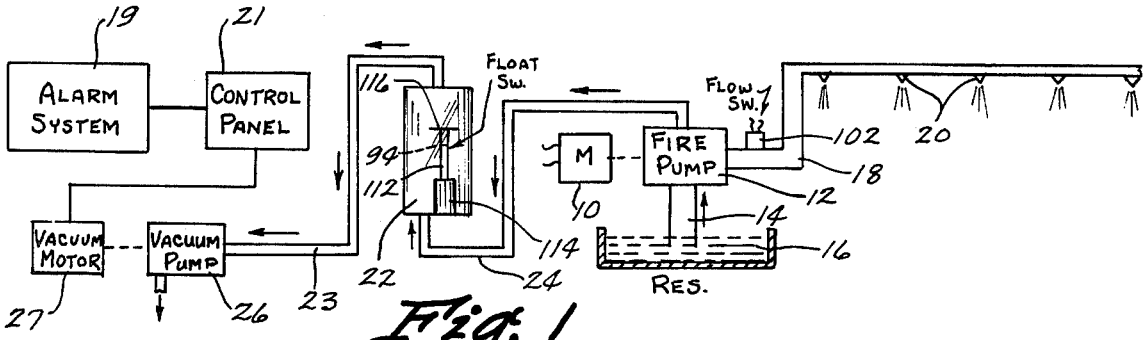
FIG. 1 is a schematic of the system.
Figure 2:
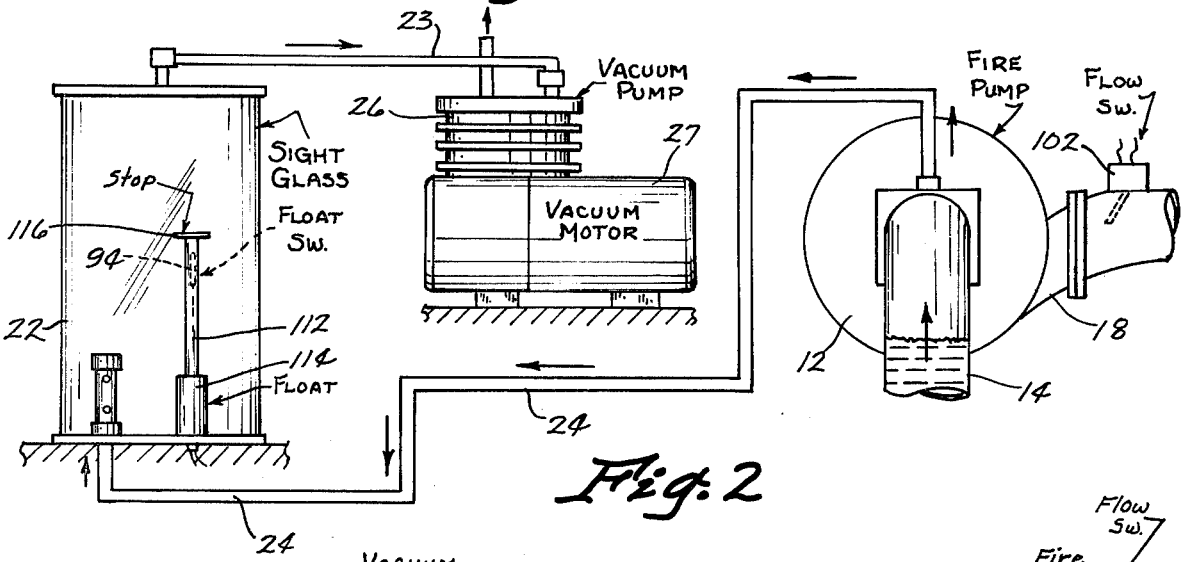
FIG. 2 is a partial schematic of the system.
Figure 3:
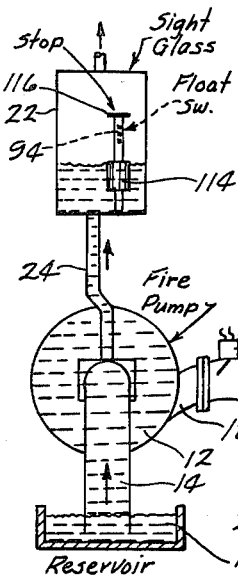
FIG. 3 is a schematic view illustrating the prime water raising the float within the sight glass.

The numeral 10 refers to a conventional magnetic contactor pump motor operatively connected to a conventional centrifugal pump 12 having a suction line 14 extending therefrom to a source of water 16 such as an underground supply tank or the like. It is recommended that a stored water supply be used and that a submerged cast concrete tank be employed with the bottom thereof no lower than 14 feet and having the top thereof covered with 24 inches to 36 inches of dirt to prevent freezing. It is also recommended that the top of the tank be provided with a pre-stressed portion to allow truck traffic over the tank. The suction pipe 14 is kept within six inches of the bottom of the tank to allow full usage of the stored water. Ordinarily in older facilities, the tank will be located just outside of the elevator office with the pump 12 being located in a concrete room in the basement of the elevator.

Discharge line 18 extends from the pump 12 to the area to be protected and has a plurality of sprinklers 20 provided thereon adapted to spray or sprinkle water onto the area in the event that a fire should occur. A conventional alarm system 19 including a fire switch 80 is located in the area to be protected and it is operatively connected to a control panel 21. Control panel 21 is electrically connected to a conventional vacuum pump 26 including a motor 27. Pump 26 has a vacuum line 23 extending therefrom to the upper portion of a transparent sight glass 22. Vacuum line 24 extends from the lower portion of the sight glass 22 to pump 12 and is in communication with the interior thereof. Generally speaking, actuation of the vacuum pump 26 causes a vacuum to be created in line 23, sight glass 22, line 24, pump 12 and line 14 so that water will be drawn upwardly through line 14, into pump 12, through line 24 and into the interior of sight glass 22 as will be described in more detail hereinafter.

Referring now to the circuitry of the invention, the numeral 28 refers generally to a source of 120 volt alternating current including leads 30 and 32. Lead 32 is connected to the vacuum pump motor 27 by leads 34 and 35. Lead 30 is connected to switch 37 of transfer relay 36 by lead 38. Contact 42 of relay 36 is connected to relay 44 by lead 46. Relay 44 includes switch 47 and contacts 48 and 50. Contact 50 is electrically connected to the motor 10 by lead 52. Switch 47 and motor 10 are electrically connected to the source of alternating current as illustrated in the drawings. As seen in the drawings, relay 44 is connected to the lead 34.

The numeral 54 refers to a transformer electrically connected to rectifier 56. Rectifier 56 is connected to relay 36 by lead 60. Rectifier 56 also has a lead 62 extending therefrom which is connected to lead 98. The numerals 69 and 71 refer to a resister and capacitor which interconnect leads 60 and 62 as illustrated in the drawings.

Lead 68 is connected to relay 70 including switch 72 and contacts 74 and 76. Lead 78 is connected to relay 70. Leads 68 and 70 are connected to the fire switch 80 of fire alarm 19. Contact 81 of test switch 82 is connected to lead 86 which connects contact 76 and motor 27. Contact 87 of switch 82 is connected to contact 40 of switch 37 by lead 88. Contact 87 is connected to lead 88 by lead 90. Relay 36 is connected to float switch 94 by lead 96. Lead 98 connects contact 100 of switch 94 with flow switch 102. Lead 110 connects contact 106 of switch 94 with contact 104 of switch 102 as seen in the drawings.

Sight glass 22 is provided with an upstanding tube 112 having a stop 116 at the upper end thereof. A normally open magnetically sensitive reed switch (float switch 94) is positioned in the upper end of the tube 112. Leads 96 and 98 are connected to the reed switch and extend downwardly through the interior of the tube 112. Float 114 slidably embraces tube 112 and rises and falls with the water level within sight glass 22. Float 114 has magnets cast into the interior of the float cavity. Float 114 is adapted to close the float switch 94 when in its uppermost position. As the float is guided up the tube 112 by the rising water level within sight glass 22, the magnets within the float 114 act on the reed switch 94 and cause it to close the circuit. Closing of the switch 94 causes the relay 36 to deactivate the vacuum pump motor and to activate the fire pump as will be described in more detail hereinafter.

Figure 4:
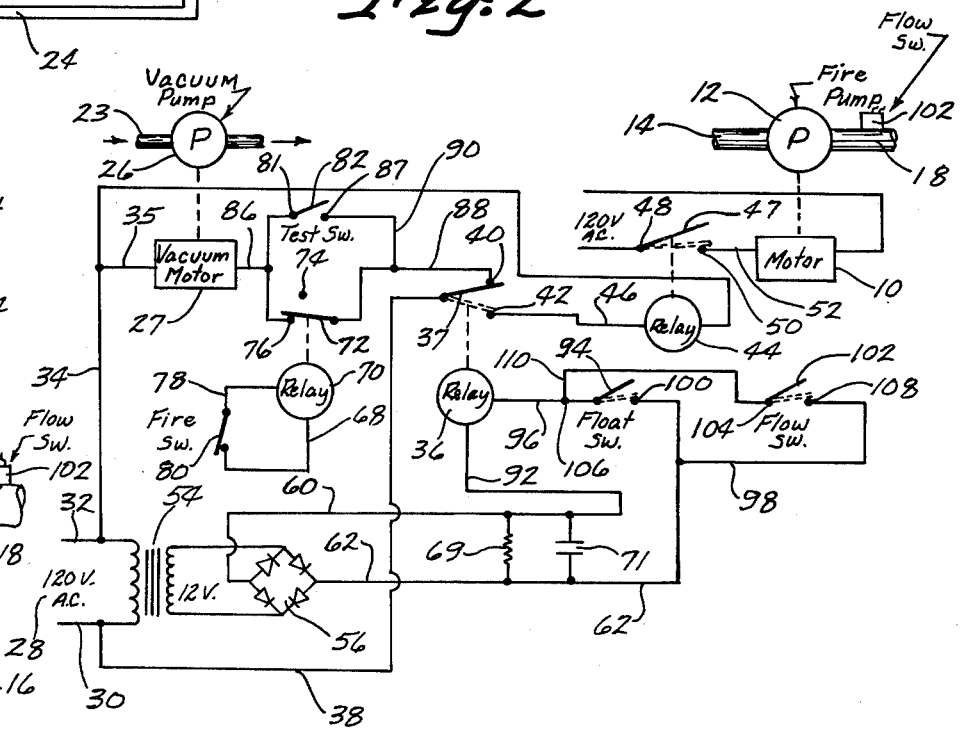
FIG. 4 is a schematic of the electrical circuitry of the invention when in an inoperative condition.
Figure 5:
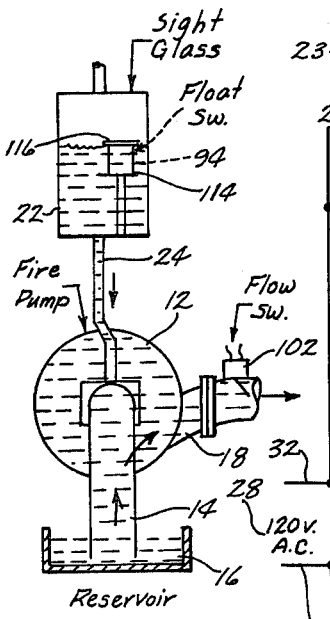
FIG. 5 is a schematic view similar to FIG. 3 except that the water level within the sight glass has risen from that of FIG. 3 to activate the system.
Figure 6:
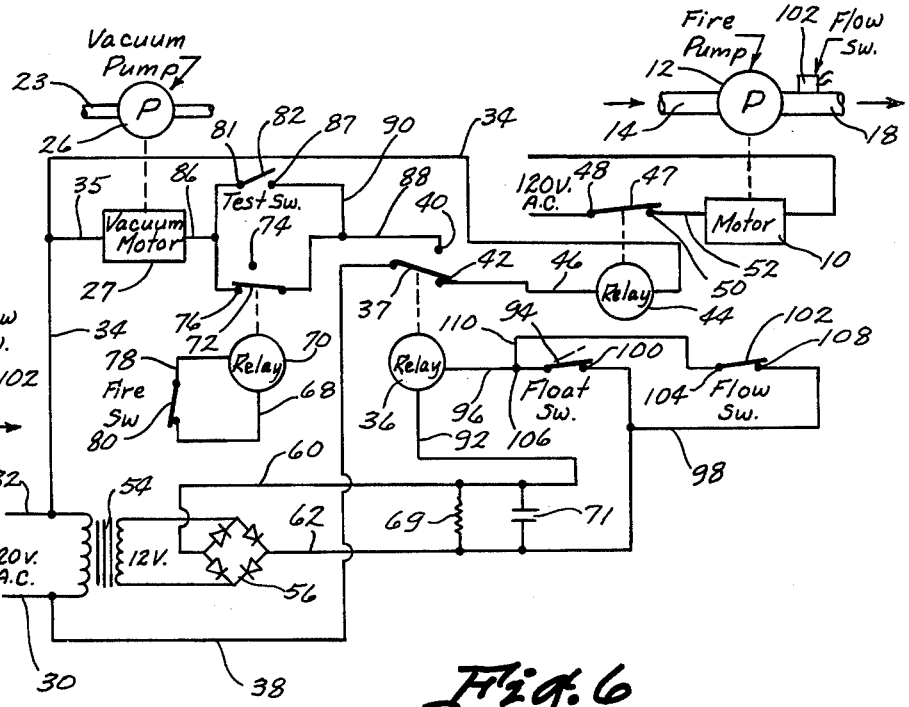
FIG. 6 is a schematic of the electrical circuitry of the invention when in an actuated position.
Figure 7:
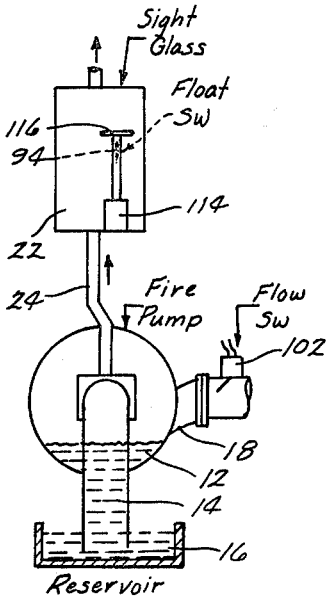
FIG. 7 is a view similar to that of FIGS. 3 and 5 illustrating the water level initially rising within the pump.
Figure 8:
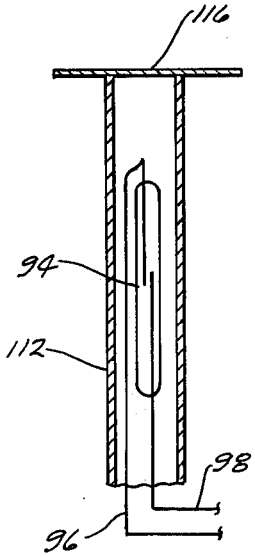
FIG. 8 is a schematic view of the float stop and reed switch.

In the stand-ready state of FIG. 4, no prime water is contained in the sight glass 22 or in the pump 12. The relays 36, 44 and 70 are unenergized at this time. If alarm system 19 senses a condition meriting sprinkler water, the fire switch 80 energizes relay 70. Energizing of relay 70 closes the contacts on the relay which causes the vacuum pump 27 to be energized or started to establish a vacuum in the sight glass 22, line 24, pump 12 and line 14. As air is exhausted from the sight glass 22, prime water will enter the pump turbine from the line 14 and will proceed to the sight glass by means of line 24. The water enters the sight glass at the lower end thereof through small orifice outlets provided therein. As the water rises in level in the sight glass 22, the magnetic float 114 moves upwardly on the pipe or tube 112 towards the upper stop position (116). As float 114 reaches stop 116, the magnets in the float 114 cause the reed switch 94 to close which energizes the transfer relay 36. It should be noted that the reed switch 94 is enclosed within the tube 112 and is isolated from water. The sight glass is then approximately one-half full of prime water which indicates a solid charge above turbine level. The closing of relay 36 breaks the circuit to vacuum pump 27 and causes the vacuum pump 27 to be deactivated. As relay 36 closes, it energizes the pump motor 10. This brings the fire pump on line while the vacuum pump is idle. As the fire pump begins to establish a head of water in the sprinkler system, the suction of the pump at the suction side is strong enough to pull the one-half full sight glass down to empty while pumping. The float 114 naturally follows the water level and very quickly is resting at the bottom of the tube 112 to open the reed switch 94. However, since there is a high pressure discharge, the flow switch 102 is closed sensing the pressure which keeps the relay 36 in a closed attitude so that the pump is self-monitoring. If during the course of pumping the prime is lost (low water, etc.), the flow switch 102 senses no flow and opens the circuit which deactivates or drops the relay 36 to deactivate the fire pump. When relay 36 is deactivated, the vacuum circuit is re-established and the cycle is restarted towards a full prime. Thus it can be seen that the fire pump cannot run without a full prime charge.

Test switch 82 is provided for in-pump room periodical testing. It is also suggested that a control switch be provided under lock and key mounted in the master breaker on the outside of the elevator for pump control in the event of a serious fire when the fire alarm might lose control or for safety reasons not to enter the plant.

Thus it can be seen that a novel apparatus has been provided for automatically water charging a centrifugal fire pump which accomplishes at least all of its stated objectives.

I claim:

1. In combination, a source of water, a fire pump means comprising an electric motor connected to a centrifugal pump, said pump being positioned at a level above said water source, said pump having a suction line in communication with said water source, said pump having a discharge line extending to an area to be protected in the event of a fire, a fire alarm system at said area to be protected, a flow switch in said pump discharge line, a vacuum system including an electric motor driven vacuum pump in operative communication with the upper end of an upstanding hollow cylinder means, a vacuum line in communication with said cylinder means at the lower end thereof and extending to said fire pump means and being in communication with the interior thereof, a vertically disposed hollow tube positioned in said hollow cylinder means and being sealed so that water in said cylinder means cannot enter said tube, a normally open magnetic float switch positioned in said tube above the lower end thereof, a float vertically movably mounted on said tube for closing said float switch when the water level in said cylinder means reaches a predetermined level, control means connecting said alarm system, vacuum system, flow switch, float switch and electric motor of said fire pump means whereby said vacuum system is initially actuated by said alarm system in the event of a fire so that a vacuum is created in said cylinder means, said vacuum line and said fire pump means to draw water upwardly through said suction line, fire pump means, vacuum line and cylinder means; said fire pump means being activated and said vacuum pump simultaneously being deactivated when said float causes said float switch to be closed; the operation of said fire pump means causing the water level to drop in said cylinder means thereby opening said float switch; said flow switch remaining closed with said fire pump means being continuously operated until said flow switch senses a predetermined drop in pressure in said pump discharge line thereby causing said flow switch to open and to deactivate said fire pump means and to reactivate said vacuum pump to initiate another priming cycle.

2. The combination of claim 1 wherein said hollow cylinder means is transparent.

* * * * *